US006560803B2

(12) United States Patent
Zur

(10) Patent No.: US 6,560,803 B2
(45) Date of Patent: May 13, 2003

(54) PRESSURE RELIEF PNEUMATIC AREA SUPPORT DEVICE AND SYSTEM

(76) Inventor: Levy Zur, 17169 Newport Club Dr., Boca Raton, FL (US) 33496

( * ) Notice: Subject to any disclaimer, the term of this patent is extended or adjusted under 35 U.S.C. 154(b) by 0 days.

(21) Appl. No.: 09/947,053

(22) Filed: Sep. 5, 2001

(65) Prior Publication Data

US 2002/0027384 A1 Mar. 7, 2002

Related U.S. Application Data

(60) Provisional application No. 60/230,103, filed on Sep. 5, 2000.

(51) Int. Cl.[7] ..... A47C 27/10
(52) U.S. Cl. ..... 5/654; 5/713; 297/284.6
(58) Field of Search ..... 5/654, 713, 710; 297/284.1, 284.3, 284.5, 284.6

(56) References Cited

U.S. PATENT DOCUMENTS

| | | | | |
|---|---|---|---|---|
| 5,029,939 A | | 7/1991 | Smith et al. | |
| 5,423,094 A | | 6/1995 | Arsenault et al. | |
| 5,444,881 A | | 8/1995 | Landi et al. | |
| 5,487,197 A | | 1/1996 | Iskra, Jr. et al. | |
| 5,500,965 A | | 3/1996 | Hannagan et al. | |
| 5,502,855 A | | 4/1996 | Graebe | |
| 5,509,155 A | | 4/1996 | Zigarac et al. | |
| 5,564,142 A | | 10/1996 | Liu | |
| 5,658,050 A | | 8/1997 | Lorbiecki | |
| 5,662,384 A | | 9/1997 | O'Neill | |
| 5,678,891 A | | 10/1997 | O'Neill | |
| 5,687,438 A | | 11/1997 | Biggie et al. | |
| 5,873,137 A | | 2/1999 | Yavets-Chen | |
| 5,881,407 A | * | 3/1999 | Chu Pt | 5/654 |
| 5,963,997 A | | 10/1999 | Hagopian | |
| 5,975,629 A | | 11/1999 | Lorbiecki | |
| 6,014,784 A | | 1/2000 | Taylor et al. | |
| 6,058,537 A | | 5/2000 | Larson | |
| 6,098,000 A | | 8/2000 | Long et al. | |
| 6,108,843 A | | 8/2000 | Suzuki et al. | |
| 6,206,465 B1 | | 3/2001 | Faust et al. | |
| 6,216,299 B1 | | 4/2001 | Kohlman | |
| 6,273,810 B1 | | 8/2001 | Rhodes, Jr. et al. | |

* cited by examiner

*Primary Examiner*—Alexander Grosz
(74) *Attorney, Agent, or Firm*—Maine & Asmus

(57) ABSTRACT

A pneumatic seat adjustable for a bedside chair, wheelchair or other type of seats, having a series of air cells controlled and operated through a micro-chip. The cells are inflated to a level of inflation adjusted to the weight of the body. In an order pre-set in the micro-chip, one cell at a time sequentially deflates for a pre-determined length of time, thus allowing unobstructed blood flow to the part of the body above the deflated cell. After the determined period of time, the cell is re-inflated to the previous level of inflation and another cell deflates. The pattern of inflation and deflation may be altered to create diverse programs and numerous applications.

15 Claims, 8 Drawing Sheets

PRESSURE RELIEF PNEUMATIC AREA SUPPORT DEVICE AND SYSTEM

CROSS REFERENCE TO RELATED APPLICATIONS

This application claims priority under 35 U.S.C. Section 119 from a Provisional Patent Application No. 60/230,103 filed on Sep. 5, 2000 that is incorporated herein by reference for all purposes.

TECHNICAL FIELD OF THE INVENTION

The present invention relates to the field of body cushions, and more particularly to support surfaces consisting of pneumatic devices that promote blood circulation through the muscles bearing body weight.

BACKGROUND OF THE INVENTION

People confined to a bed and/or wheelchair for prolonged periods or time are at risk for developing pressure sores, which result from excessive pressure applied to the capillaries lying between a bony part of the body and the surface of the bed or scat. In a seated position, the majority of the person's body weight is supported by a very small area underneath the buttocks. Passive means such as air, gel or foam cushions claim to be the best devices for redistributing the weight of the person sitting on them. Yet neither method is satisfactory in eliminating the pressure on capillaries created as the result of capillaries being pressed against the bony parts of the buttocks when seated. The pressure points where the majority of the weight rests restricts the blood flow through the capillaries.

The creation of a pressure sore requires a combination of two main elements: pressure and time. Thus, pressure in excess of the capillary pressure for a prolonged time creates pressure sores. Reducing the pressure under the capillary pressure in the most vulnerable parts of the buttock requires the application of means that would allow periodical relief, thus allowing an unobstructed flow of blood for short periods of time to the oxygen deprived areas.

Other active pads typically include two sets of interspaced transverse inflatable tubular elements, which are alternately inflated and deflated, thus providing alternating pressure relief to the buttock area. Such devices are usually comprised of 4 or 6 tubular elements. An example of such a system is disclosed in U.S. Pat. No. 5,500,965 that uses two sets of elements, each composed of two chambers that inflate and deflate. Alternating between the inflated and deflated tubes results in having the body supported by half of the entire surface, causing a significant increase of pressure, already higher than the capillary pressure, on those body parts supported by the inflated tubes.

However, alternating the pressure on the body part by using large air cells does not effectively alleviate the pressure points to permit proper blood flow through the capillaries and prevent the aforementioned problems.

What is needed is a device that is capable of sequentially relieving the air pressure, in a controlled fashion, with minimum pressure increase on the remaining cells that continue supporting the weight of the body. Such a device should employ smaller air cells that can re-distribute the weight and allow proper circulation across the entire buttocks area when seated. The device should be easily incorporated into existing designs and cost-effective. Furthermore the device should be adaptable to numerous applications such as motor vehicles, buses, trucks, construction equipment, wheelchairs, and all various chair embodiments.

SUMMARY OF THE INVENTION

Accordingly, an object of the present invention is a pneumatic cushion consisting of a plurality of air cells constructed of soft, airtight, non-elastic material, mounted on a rigid or semi-rigid base to be installed on a wheelchair, bedside chair or any other support surface.

The present invention is a sequential pressure relief seat for therapeutic treatment of immobile persons to prevent pressure sores and skin break down and promote blood flow comprising an array of airtight cells, tubular in shape, mounted side-by-side in a vertical position upon a rigid base. Their is a layer of foam that encircles the array with the array of air tight cells, so that when the multiple air cells are inflated they form a uniform surface. A power supply is interconnected to furnish electrical power to the air supply unit and the various valves requiring power. An air supply unit provides pressurized air to the array of air cells, and the air supply unit is connected to a battery or AC outlet. There is an electrically operated air valve controlling the direction of the air flow to or from the air cells, with a control means for controlling the inflating and deflating order of the air cells. The control means typically consists of a pressure sensor, a microprocessor, and a memory chip. At least one electronically controlled selector valves directs the air to or from the selected air cells.

The sequential pressure relief seat device is used in a chair, wherein a control case houses the supply unit parts including the air pump, battery, air valve and the control unit parts including the pressure sensor, the microprocessor and the memory chip. A set of selector valves, such as a two eight-way or four four-way or eight two-way or sixteen one-way, electronically controlled to direct the air flow independently to and from each one of the air cells. In a preferred embodiment the plurality of tubular air cells is sixteen or more. One embodiment is for a relief seat that is built with seven or more air cells, the air cells having a square shape, positioned side-by-side to form a "no gap" surface when inflated.

The air cells are typically tubular shaped, although they might be designed in any other shape mounted in proximity to each other, to provide an even cushioned surface. Unlike the prior art devices, the air cells are mounted on the base of the cushion in a vertical position, or perpendicular to the base. The number of air cells varies according to the size and shape of the seat and the desired function, however in a preferred embodiment there should be enough cells to properly alleviate pressure and increase blood flow. The matrix of air cells might be enclosed around the perimeter and supported by a frame of foam that conforms to the shape of the chair. Each such air cell is linked at its bottom to an air tube, wherein each tube connects at least one cell to a battery-powered pump that provides pressurized air.

The air, flowing from the pump through the pressure sensor and the tubes, is regulated by one or a number of controllable selector valves that provide three-way positions: closed; open to release air from the cell; open to push air to the cell.

A control unit that includes a microprocessor and memory for storing information relating to pressures within the air cells communicates electronically with the valves to select the appropriate position: closed, open to inflate or open to deflate. The pattern, order and sequence in which the air cells inflate and deflate are pre-programmed and embedded in the microprocessor. The system is set in motion by pressing a single button located in a convenient, easy to reach handle of the chair. The system may include a back-up rechargeable battery to allow mobility and uninterrupted operation in case of electrical power interruption.

Given the relatively small size of its air cells, it is another object of the present invention to provide a pulsating effect resulting in an acceleration of the blood flow through the buttock area.

As described herein, an object of the invention is a sequential pressure relief device for use in seating, comprising a plurality of air cells mounted vertically on a semi-rigid base. The semi-rigid base provides some flexure, however it is also within the scope of the invention to use a rigid base. There is a support layer encircling the plurality of air cells. An air supply unit provides pressurized air to the plurality of air cells and there is an electrically operated valve controlling air flow to the plurality of air cells, with a control means for inflating and deflating selected air cells. Additionally, there is at least one electronically controlled selector valve directing the air to the selected air cells.

A further object is the sequential pressure relief device, wherein the power supply, the electrically operated valve, the control means, and the electronically controlled selector valve are connected to a main ON/OFF switch. The main On/Off switch is chosen from the group consisting of a manual switch, a voice activated switch and a foot operated switch.

A further object is the sequential pressure relief device, wherein the power supply is a DC storage battery. Alternatively, the system can use an AC/DC converter and connect to an AC power source.

Yet an additional object is the sequential pressure relief device, wherein each of the cells have a shape chosen from the group of shapes such as hexagonal prism, cylinder, rectangular prism, and square prism. In one embodiment, each of the cells have diameters of about approximately three inches and each of the cells is approximately three inches in height. Furthermore, in a preferred embodiment the sequential pressure relief device has a minimum of seven air cells.

An object includes the provision of a sequential pressure relief device wherein the control means comprises a microcontroller with or without a memory device. In particular. wherein the memory device is an erasable electronically programmable read only memory with an inflation/deflation sequence. And even more particularly, wherein the sequence can be customized by the user.

And a further object is the provision of a sequential pressure relief device wherein the device is selected from the group consisting of a stationary chair, a lounge chair, a wheel chair, and a seat of a motor vehicle.

An object of the invention is the provision of a sequential pressure relief device for use in a motor vehicle, comprising a plurality of air cells mounted on a rigid base, wherein the cells are perpendicular to the base. There is a support layer encircling the plurality of air cells, providing a uniform surface when in hated. An air supply unit provides pressurized air to the plurality of air cells. And there is an electrically operated valve controlling air flow to the plurality of air cells the control means for inflating and deflating selected air cells is with a memory device having a programmed inflation/deflation sequence for the air cells and at least one electronically controlled selector valve directing the air to and from the selected air cells.

And an even further embodiment is for the sequential pressure relief device, wherein a power supply is from a motor vehicles power system and air supply is generated from a motor vehicle air system. Connecting the system into a vehicle allows the flexibility to use the electrical system, including the battery of the vehicle. The cars also come with air blowing units wherein the seating system can be adapted to supply the required pressurized air supply for the cells from the car air blowing unit.

Another embodiment of the sequential pressure relief device has an inflation/deflation sequence. One example of the inflation/deflation sequence operates using sixteen air cells sequentially inflating a first cell in row two in conjunction with a last cell in row three followed by a last cell in row two in conjunction with a first cell in row three followed by with all four cells in row one followed by four cells in row four. This diagonal inner inflation is just one of the embodiments. Another embodiment for the inflation/deflation sequence operates using sixteen air cells sequentially inflating a first cell in row two in conjunction with a last cell in row two, followed by a first cell in row three in conjunction with a last cell in row three, followed by all four cells in row one, followed by four cells in row four.

Still other objects and advantages of the present invention will become readily apparent to those skilled in this art from the following detailed description. As will be realized, the invention is capable of other and different embodiments. The invention's several details are capable of modification in various respects without departing from the spirit of the invention.

BRIEF DESCRIPTION OF THE DRAWINGS

The present invention will be readily understood by the following detailed description in conjunction with the accompanying drawings, wherein like reference numerals designate like structural elements.

DESCRIPTION OF THE PREFERRED EMBODIMENT

Figure 1:
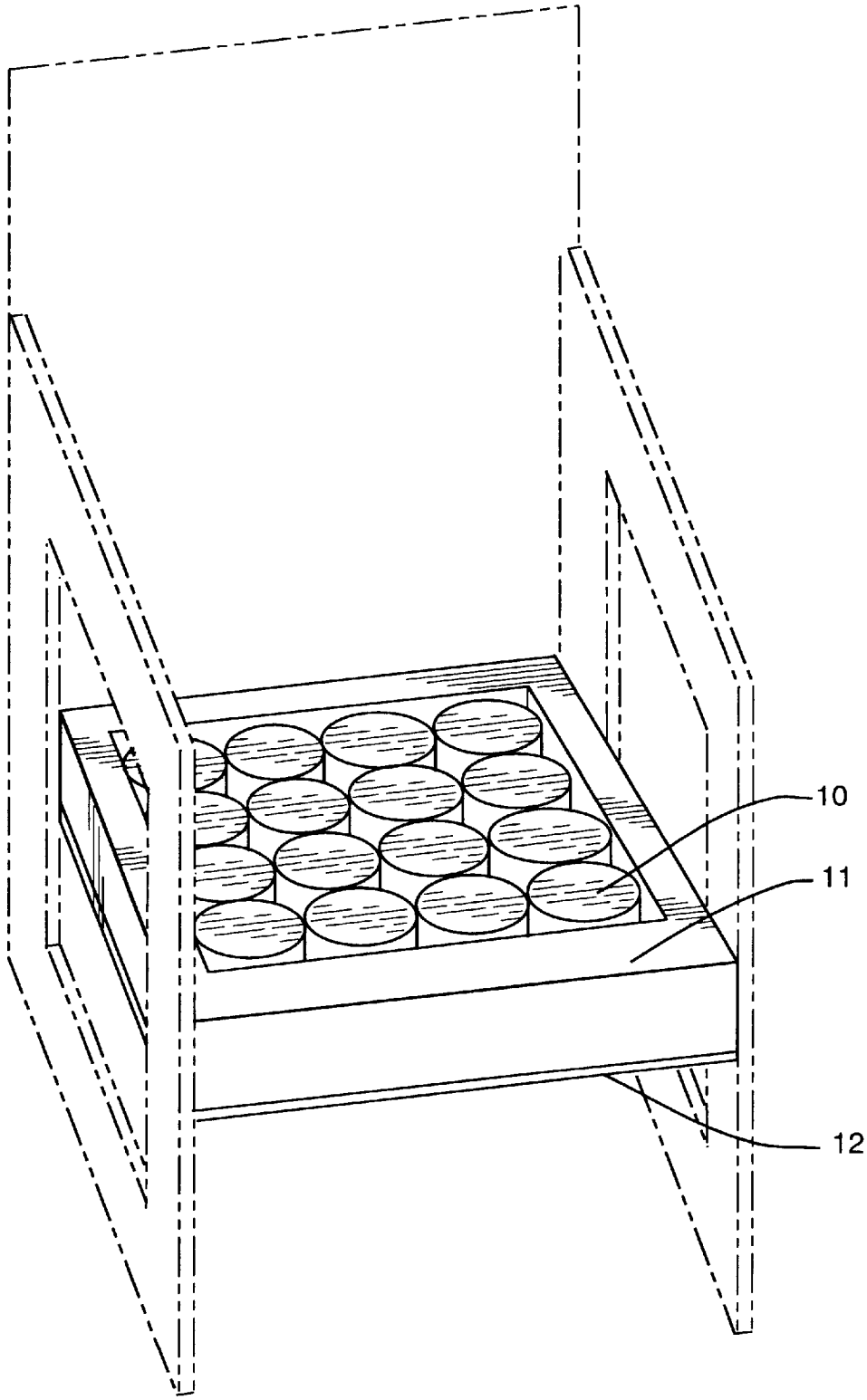
FIG. 1 A bedside chair or a conventional resting chair, containing 12 or 16 air cells sequentially inflated and deflated FIG. 2 A removable cushion of a bedside chair or a conventional chair FIG. 3 A removable, self contained seat/pad for the wheelchair FIG. 4 A wheelchair with a pneumatic seat containing seven air cells sequentially inflated and deflated, wherein the number of air cells might be increased to eleven or thirteen in large size wheelchairs.
Figure 6:
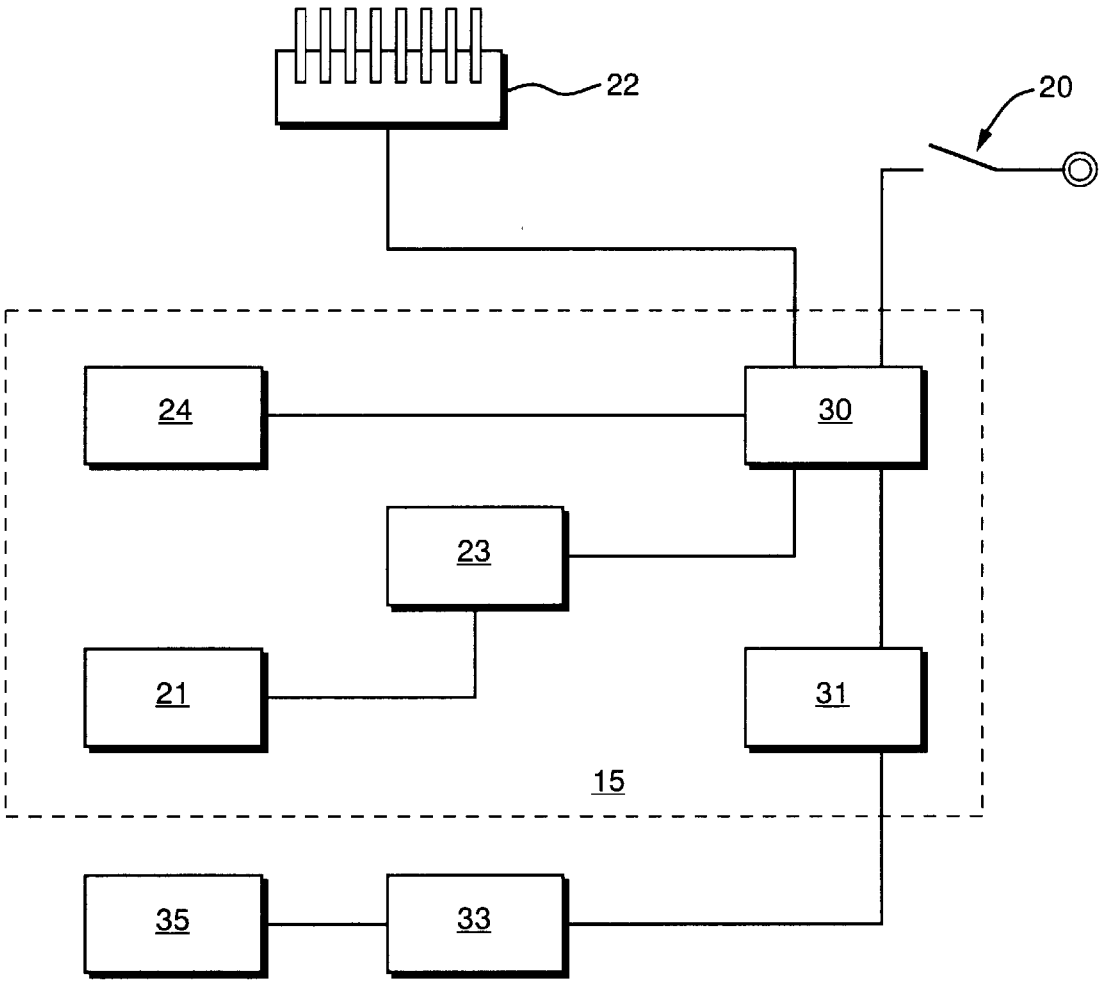
FIG. 6 A diagram of the electrical components of the system

Referring to FIGS. 1 and 6, a chair is shown with a pneumatic support seat that contains about 16 tubular shaped air cells 10. The array of air cells 10 is encircled by a frame of foam 11 to conform to the shape of the chair and support sidewise the air cells. The air cells 10 and the foam layer 11 are placed on and connected to the rigid base of the seat 12. The seat 12 has a cover and the entire seat is removably attached to the frame of the chair. The On/Off main switch 20 may be conveniently located on the armrest of the chair for easy reach by the person seated on the chair.

Although the air cell size is not limited to a particular size or shape, in one embodiment the air cells are three inches in diameter and three inches in height. This provides a relatively large number of individual air cells that support the weight and provide sufficient redistribution of the weight to promote circulation.

One embodiment comprises one or more selector valves 22 located in the rear of the seat, connecting in the inlet side with the conduit of pressurized air from the pump 21 and in the outlet side to the air cells 10. The remaining parts of the system, including the air pump 21, the pressure sensor 23, the air-flow valve 24, the battery 31 and the control unit 30 are located under the seat in a separate case called "the supply unit" 15. Alternatively, the system components can also be mounted on the sides of the seat over the rigid base and within the foam frame. As long as they are in somewhat close proximity, the wiring and tubing can run several feet from the cells.

Figure 5:
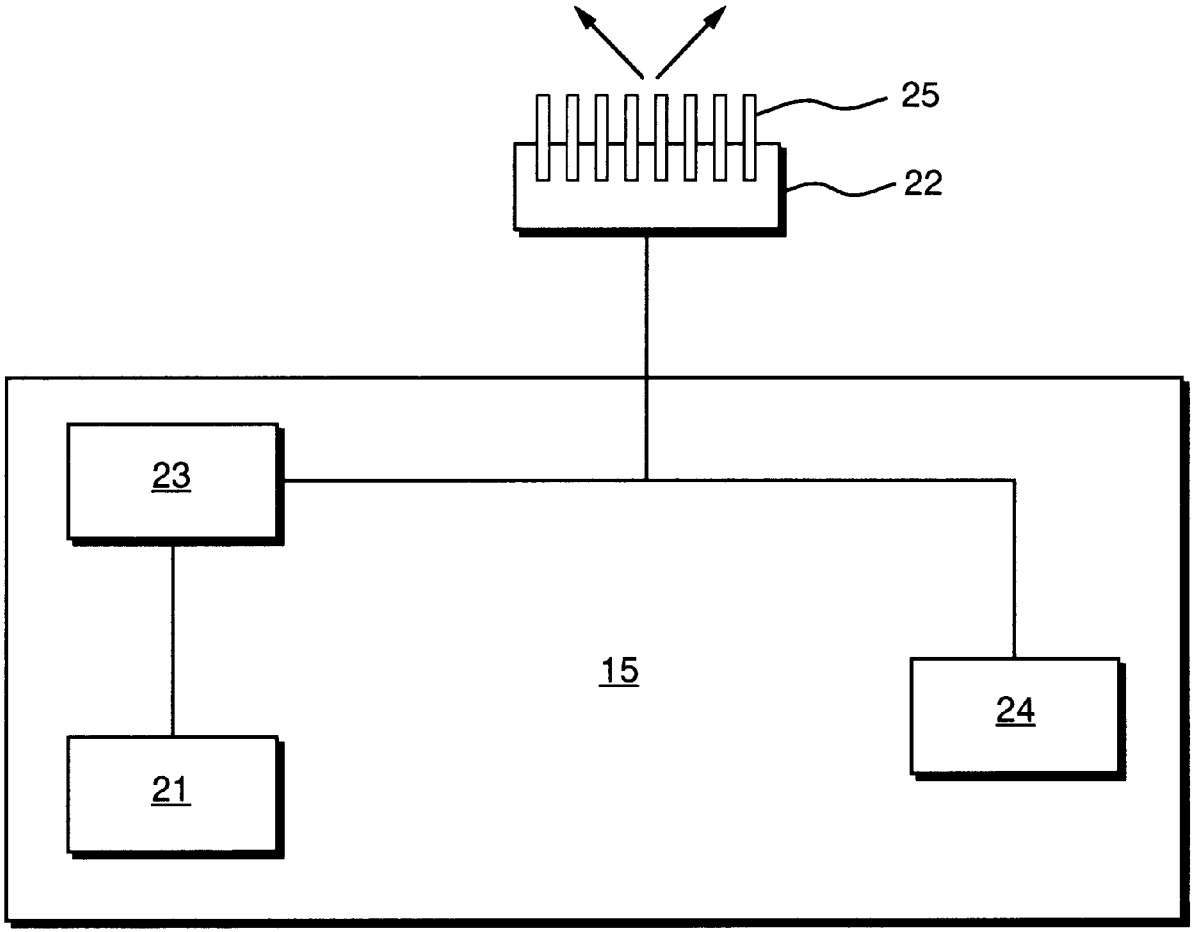
FIG. 5 A diagram of the pneumatic components of the system
Figure 9:
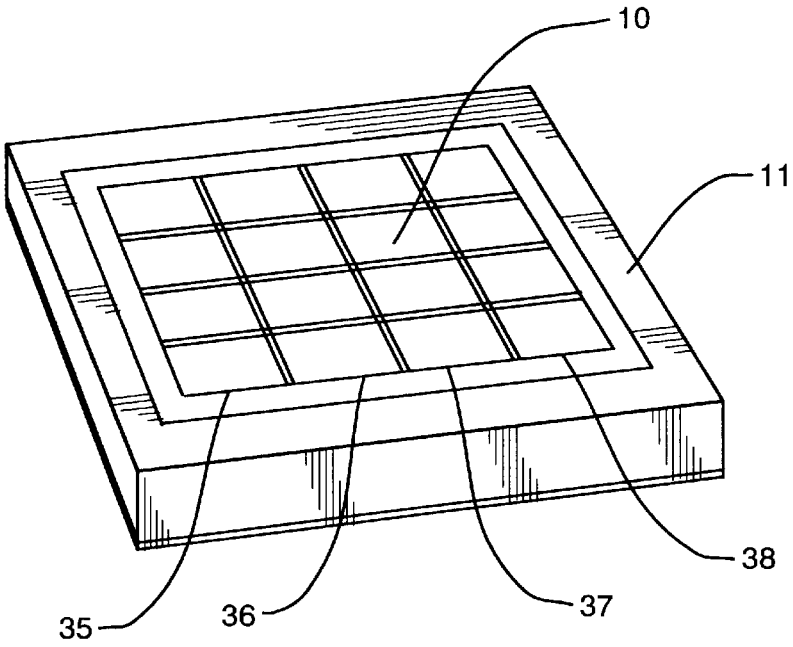
FIG. 9 A seat with sixteen square shaped air cells.

The supply unit 15 has four connections that are illustrated in FIGS. 5 and 6. In FIG. 6, the electrical system is powered from an electrical connection from a wall outlet 35 through the AC/DC adapter 33 to charge the battery 3 1. There is an electrical connection from the ON/OFF main switch 20 to the control unit 30, as well as connections between the control unit 30 and the selector valves 22, the airflow control valve 24 and the pressure sensor 23 and air pump 21. A "no gap" embodiment is shown in FIG. 9.

Figure 2:
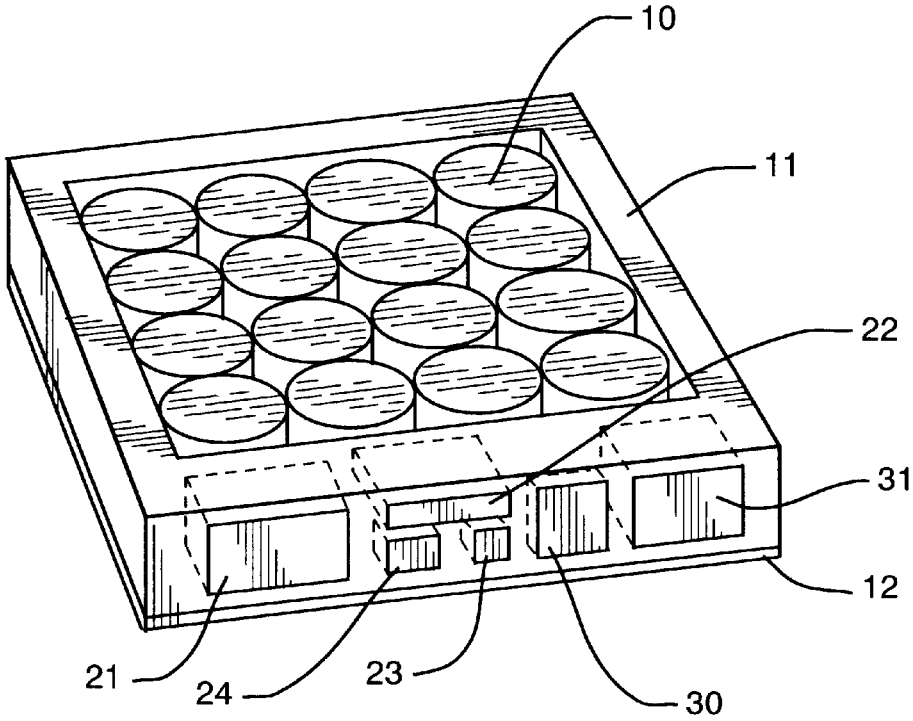

Alternatively, the supply unit 15 components are located alongside the selector valves 22 as illustrated in FIG. 2. In this case, the self-contained seat has an electrical connection to the wall outlet 35, a connection to the ON/OFF switch 20 and an electrical connection to the selector valve 22, wherein the selector valves 22 are immediately adjacent the control unit 30.

FIG. 2 shows a pneumatic support seat from the rear side of the seat with the supply and control components embedded in the rear side of the seat over the rigid base and within the foam frame 11. The components and component layout are shown, and include the air pump 21, one or more selector valves 22 with tubes connecting to each one of the air cells 10, a pressure sensor 23, an airflow control valve 24, the control unit 30 and the battery 31. The control unit 30 contains the micro-chip (also known as microcontroller), which has resident firmware and processes the various signals and controls the operation.

The micro-chip controls the inflation and deflation, although some customization is possible. There are various sequences of timing related to the inflation cycle and issued U.S. Pat. No. 5,873,137 is incorporated by reference.

Figure 3:
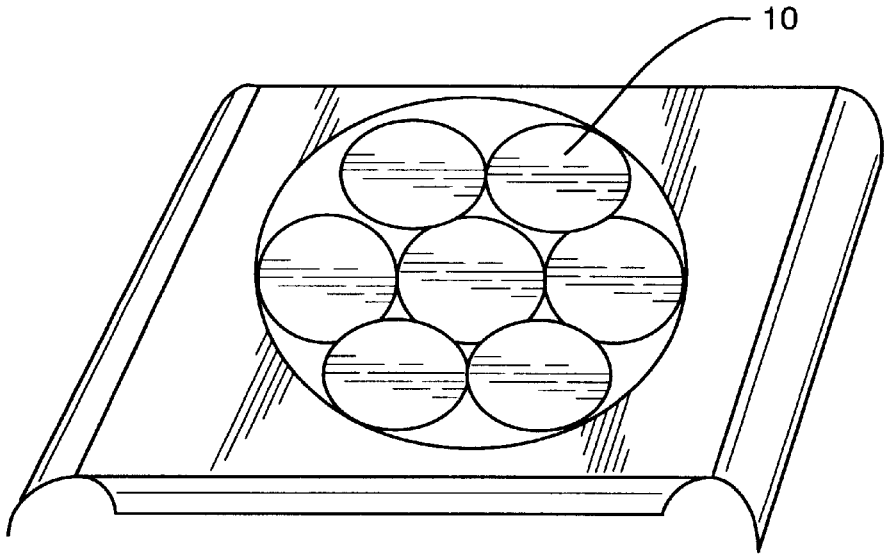

Alternatively, FIG. 3 shows a removable and self-contained wheelchair seat with about 7 air cells. The edges of the rigid base of the seat are rounded, to allow the seat to hang on the frame of the folding wheelchair. The top of the seat has a thin layer of foam surrounding the array of air cells and is leveled with them when fully inflated. The selector valve 22 and all the components of the supply unit are disposed under the rigid base around the array of air cells 10. The supply and control components are placed underneath of the rigid or semi-rigid seat surrounding the array of the air cells.

Figure 4:
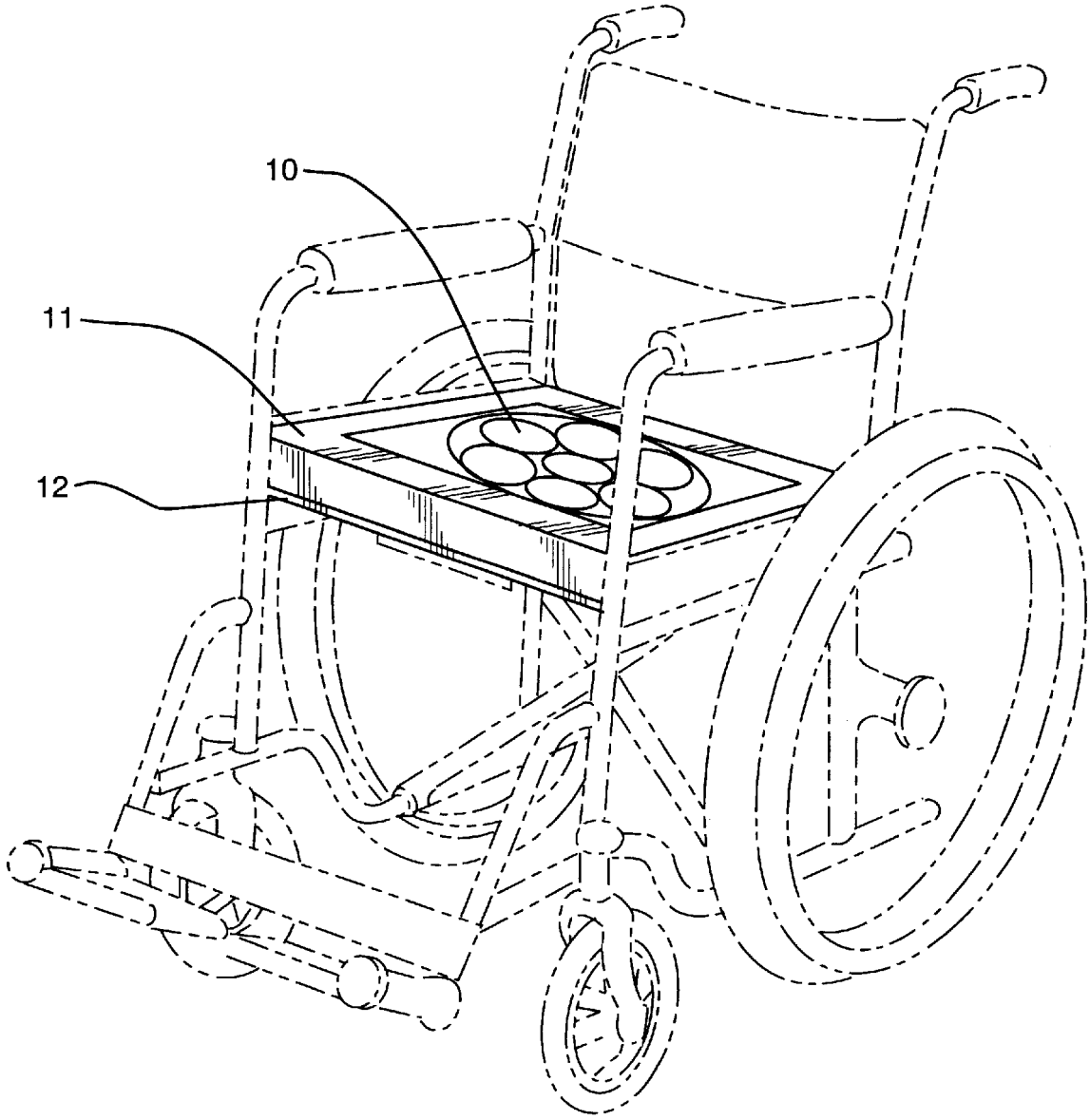

The self-contained seat has a connector leading to the wall outlet 35 for battery recharge when the wheelchair is at rest. The On/Off switch 20 is located either on the side of the seat for easy reach or on the armrest. When the wheelchair needs to be folded, the recharge connector should be disconnected. The seat can be lifted from the wheelchair frame and easily carried along with the folded wheelchair. FIG. 4 shows the wheelchair seat placed on a lightweight, folding wheelchair.

FIG. 5 shows a sketch of the air supply chain and components, including the air pump 21, the pressure sensor 23, the air-flow control valve 24, the selector valve 22 and the tubing 25 connecting them. Plastic tubing is used, as it is lightweight and flexible.

FIG. 6 shows a sketch of the command chain and components, including the battery 31, the control unit 30 with the micro chip and the electrical connections with the air supply components. The battery 31 is charged and can be used if electrical power is lost or unavailable.

It is well known in the art that the battery 31 can be replaced with an AC/DC converter rather than maintaining the battery unit 31, allowing the household AC electrical system to run the present invention. The unit can also be powered from a DC system that includes a battery, such as in a motor vehicle. The present invention can be easily incorporated into a motor vehicle such as a car, truck, van, bus, or motorcycle and utilize the existing automotive DC power system. In particular, the invention can be used in the trucking industry to alleviate the medical problems associated with long hours in a seated position.

In a preferred embodiment the microcontroller is an electronically programmable read only memory (EPROM) that is programmed at the factory or from the supplier. The microcontroller in another embodiment is an erasable electronically programmable read only memory (EEPROM) unit and can be reprogrammed by the user with an additional accessory or through the manufacturer to customize the sequence, repetition rate, and pressure of the air cells.

It should also be readily apparent that the On/Off switch 20 of the present invention can be replaced by a different switching scheme. Voice recognition can be used to activate or deactivate the system for those unable to utilize a manual switch. Alternatively, a foot-operated switch can also be implemented to activate the system.

And it should also be realized that the physical electrical connections could be replaced using wireless technology. The controller can implement the wireless techniques well known in the art to interrogate and control the pressure sensor 23, air pump 21, sensor valves 22, On/Off switch 20 and air-flow valve 24.

Figure 7:
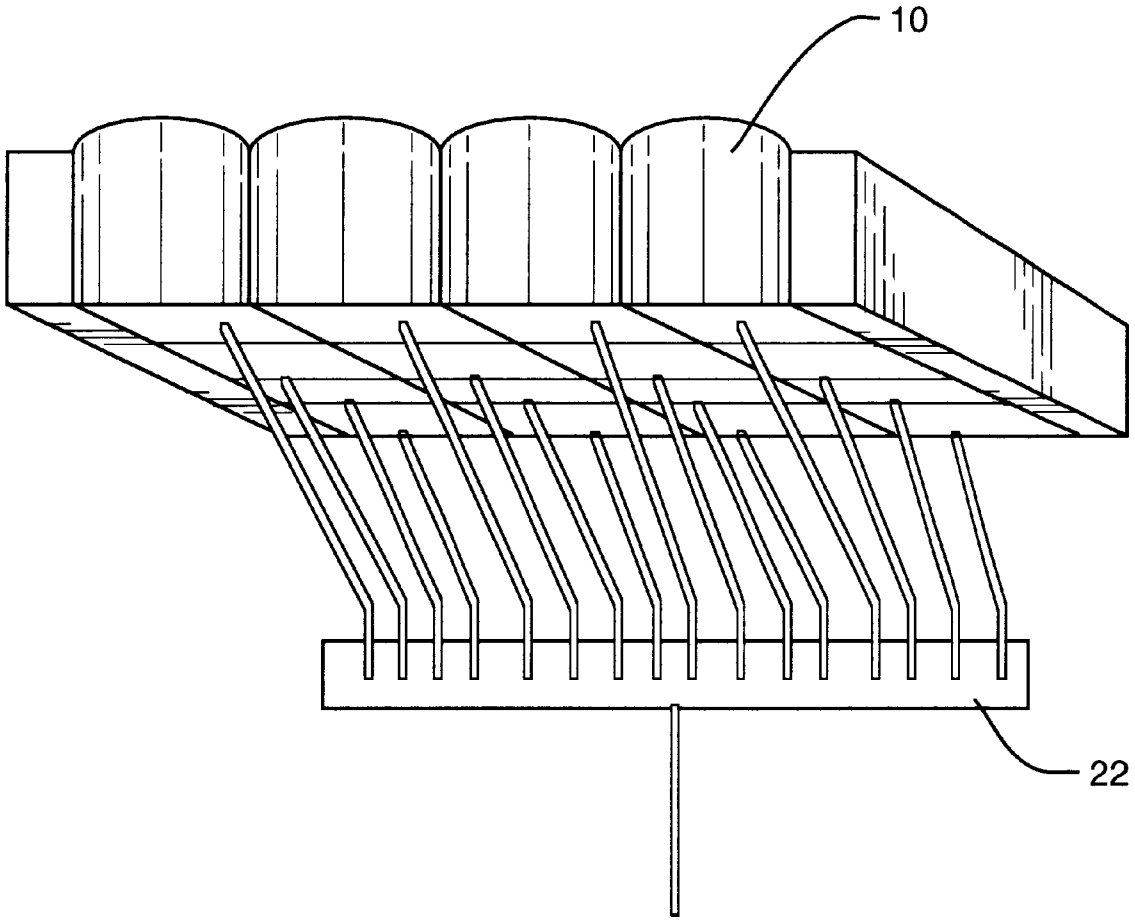
FIG. 7 A seat with sixteen air cells individually supplied and controlled.

A seat with sixteen air cells 10 for a bed side or conventional chair with one or more selector valves 22 with sixteen supply channels that allows control and supply of pressurized air to each cell individually is illustrated in FIG. 7.

Figure 8:
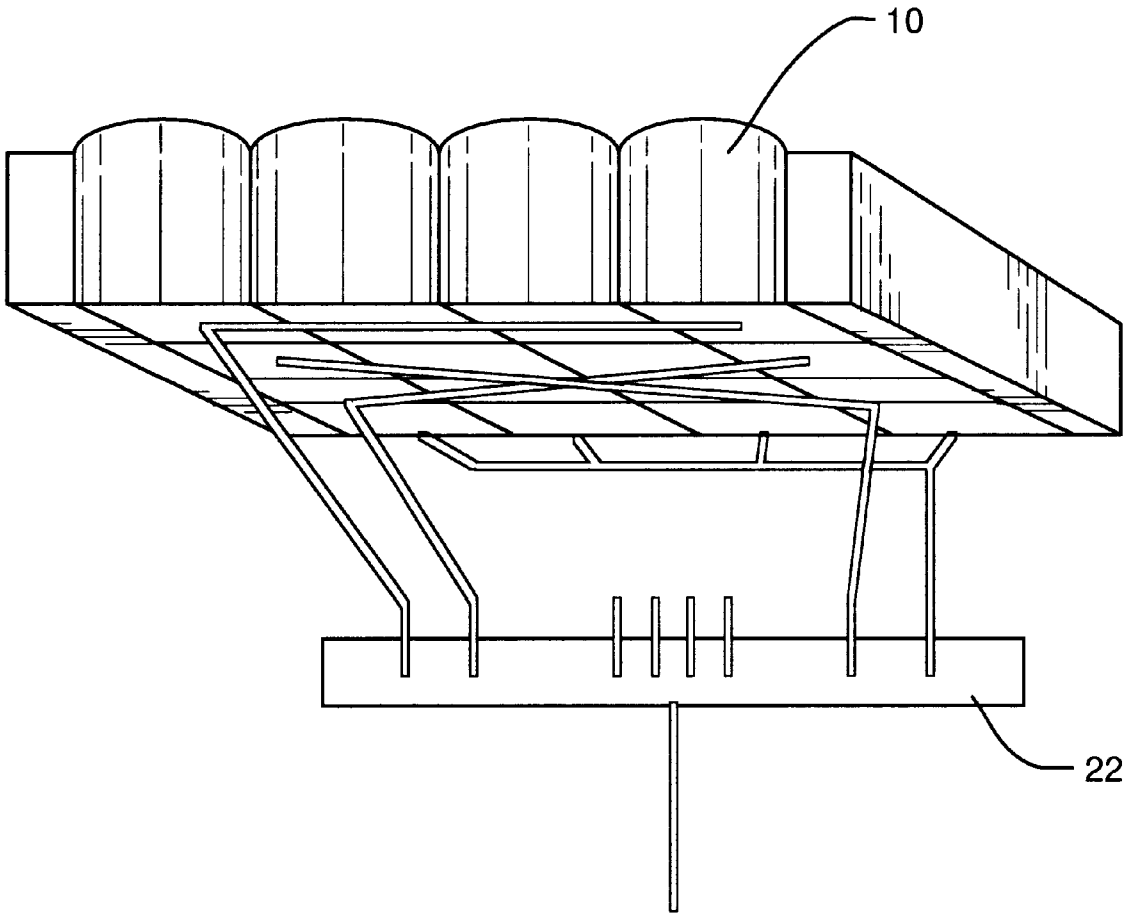
FIG. 8 Same seat with variable interconnections between the air cells.

In contrast, FIG. 8 shows a seat with sixteen air cells 10 with one or more selector valves 22 with eight supply channels. The four center air cells are activated individually. The four air cells in the front of the seat, as well as the four air cells in the back of the seat are activated together. Two air cells diagonally across from each other on the side of the seat are activated together.

The no gap seat embodiment with sixteen square-shaped air cells is shown in FIG. 9. In this embodiment, there are four rows 35, 36, 37, 38, with four cells 10 in each row. As noted herein, each cell 10 can be activated individually within each row 35, 36, 37, 38. Alternatively, groups of cells 10 within the rows 35, 36, 37, 38 can be activated together as detailed herein.

Figure 10:
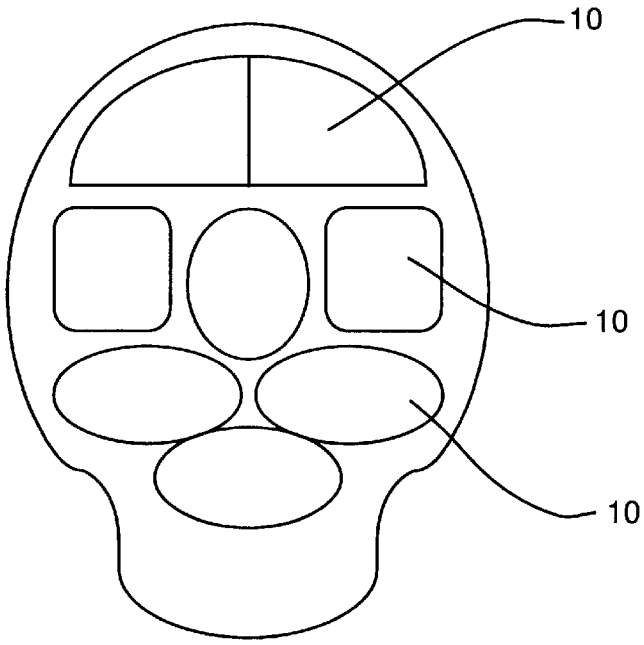
FIG. 10 A scooter seat with variable shaped air cells.

FIG. 10 shows a typical scooter seat with about eight variable shape air cells 10 to conform the specific shape of a scooter seat shape or other required seat shapes. In a scooter, car seat, or special seat, the array of air cells is embedded in the seat. The number and the shape of the air cell 10 vary to conform to the shape of the seat. In a scooter, the battery is used to supply the electrical power from the scooter's battery. In a car seat, the motor vehicle is the source of the electrical power and the pressurized air required for this invention.

The dimensions of the air cells are intended to alleviate the main pressure points of the buttocks when seated. The location of the pressure points will vary depending upon the person, the application, the chair, and the seating position. Although various shapes and dimensions are within the scope of the embodiment, the pressure points associated with the bony part of the buttocks can be defined as averaging about three to four inches across in circumference. The depth of the air cells also is variable depending upon the implementation. A narrow version of the invention requires a height restricted air cell, while other embodiments can use full height air cells. By inflating the cells around the main pressure points and deflating the pressure point cell(s), the other cells support the weight and the pressure point region is less restricted and blood flow is improved.

In operation of one embodiment, the system is powered by a battery 31 that is kept in a fully charged state by the AC household electrical system via an AC/DC adapter. The user activates the On/Off switch 20, which is received by the control unit 30. The control unit, which may have been in an idle or sleep state, activates and interrogates the sensors and units connected to the control unit 30. Depending upon the firmware programming, an appropriate algorithm is selected for the air pressure, repetition rate of air cell activation/deactivation, and the air cell pattern to be used. The air pump 21 generates the appropriate air pressure, which is monitored by the pressure sensor 23. The control unit 30 opens the proper selector valves 22, which inflates the corresponding air cells. The airflow control valve 24 is used to deflate the selected air cells. The inflation cycle continues per the algorithm of the micro-chip.

In a preferred embodiment, a multi-way selector, such as an electronically controlled one eight-way selector valve directs the air flow to and from the air cells in the following pattern using four central air cells operating individually: the first cell in row #2 in conjunction with the last cell in row #3; the last cell in row #2 in conjunction with the first cell in row #3; the four cells in row #1 simultaneously; and the four cells in row #4 simultaneously, wherein the pattern may accommodate any number of cells.

The present invention has been particularly shown and described with respect to certain preferred embodiments of features. However, it should be readily apparent to those of ordinary skill in the art that various changes and modifications in form and details may be made without departing from the spirit and scope of the invention. The objects and advantages of the invention may be further realized and attained by means of the instrumentalities and combinations particularly pointed out in the appended claims. The drawings and description are to be regarded as illustrative in nature, and not as restrictive.

What is claimed is:

1. A sequential pressure relief device for use in seating, comprising:

a plurality or air cells mounted vertically on a semi-rigid base, wherein said air cells are substantially cylindrical, and wherein each of said cells are approximately three inches in diameter and approximately three inches in height;

a support layer encircling said plurality of air cells;

a power supply;

an air supply unit for providing pressurized air to said plurality of air cells;

an electrically operated valve coupled La said power supply controlling air flow to said plurality of air cells, wherein each said cell is independently coupled to said air supply;

a pressure sensor coupled to each of said air cells;

a control means for inflating and deflating selected air cells; and at least one electronically controlled selector valve directing said air to said selected air cells.

2. The sequential pressure relief device of claim 1, wherein said power supply, said electrically operated valve, said control means, and said electronically controlled selector valve are connected to a main ON/OFF switch.

3. The sequential pressure relief device of claim 2, wherein said main ON/OFF switch is chosen from the group consisting of a manual switch, a voice activated switch and a foot operated switch.

4. The sequential pressure relief device of claim 3, wherein said power supply is a DC battery.

5. The sequential pressure relief device of claim 1, further comprising an AC/DC converter and connecting to an AC power source.

6. The sequential pressure relief device of claim 1, having at least seven air cells.

7. The sequential pressure relief device of claim 1, wherein said control means is a microcontroller.

8. The sequential pressure relief device of claim 7, further comprising a memory device.

9. The sequential pressure relief device of claim 8, wherein said memory device is an erasable electronically programmable read only memory with an inflation/deflation sequence.

10. The sequential pressure relief device of claim 1 wherein said sequential pressure relief device is installed in seating selected from the group consisting of a stationary chair, a lounge chair, a wheel chair, and a seat of a motor vehicle.

11. A sequential pressure relief device for use in a motor vehicle, comprising:

a plurality of air cells mounted on a base, wherein said air cells are perpendicular to said base, wherein said air cells arc substantially cylindrical, and wherein each of said cells arc approximately three inches in diameter and approximately three inches in height;

a support layer encircling said plurality of air cells, providing a planar surface when said cells are inflated;

a power supply an air supply unit for providing pressurized air to said plurality of air cells;

an electrically operated valve controlling air flow to said plurality of air cells, wherein each said air cell is independently coupled to said air supply unit and a pressure sensor;

a control means for inflating and deflating each of said air cells in conjunction with said pressure sensor, wherein said control means comprises a memory device having a programmed inflation/deflation sequence for said air cells; and at least one electronically controlled selector valve directing said air to and from said air cells.

12. The sequential pressure relief device according to claim 11, wherein said memory device is an erasable electronically programmed read only memory that is customizable by a user.

13. The sequential pressure relief device according to claim 11, wherein said inflation/deflation sequence operates using sixteen air cells sequentially inflating a first cell in row two in conjunction with a last cell in row three followed by a last cell in row two in conjunction with a first cell in row three followed by with all four cells in row one followed by four cells in row four.

14. The sequential pressure relief device according to claim 11, wherein said inflation/deflation sequence operates using sixteen air cells sequentially inflating a first cell in row two in conjunction with a last cell in row two, followed by a first cell in row three in conjunction with a last cell in row three, followed by all four cells in row one, followed by four cells in row four.

15. The sequential pressure relief device of claim 11, wherein said power supply is from a motor vehicles power system and said air supply is from a motor vehicle air system.

* * * * *